US010400303B2

(12) United States Patent
Porter et al.

(10) Patent No.: US 10,400,303 B2
(45) **Date of Patent: *Sep. 3, 2019**

(54) APPARATUSES AND METHODS FOR PROCESSING A METAL RIBBON

(71) Applicant: The Boeing Company, Huntington Beach, CA (US)

(72) Inventors: John Richard Porter, Edgewood, WA (US); Stephen Thomas Johnson, Kent, WA (US); Mark Frederick Gabriel, Renton, WA (US); Lisa Ann Cardon, Lake Tapps, WA (US)

(73) Assignee: The Boeing Company, Chicago, IL (US)

( * ) Notice: Subject to any disclaimer, the term of this patent is extended or adjusted under 35 U.S.C. 154(b) by 129 days.

This patent is subject to a terminal disclaimer.

(21) Appl. No.: 15/438,217

(22) Filed: Feb. 21, 2017

(65) Prior Publication Data

US 2017/0159152 A1 Jun. 8, 2017

Related U.S. Application Data

(63) Continuation of application No. 14/588,637, filed on Jan. 2, 2015, now Pat. No. 9,708,686.

(51) Int. Cl.

| | |
|---|---|
| ***C21D 9/573*** | (2006.01) |
| ***C22F 1/04*** | (2006.01) |
| ***C22F 1/00*** | (2006.01) |
| ***C22C 21/00*** | (2006.01) |
| ***B21C 1/02*** | (2006.01) |

(Continued)

(52) U.S. Cl.

CPC ..... *C21D 9/5735* (2013.01); *B21C 1/02* (2013.01); *C21D 1/60* (2013.01); *C21D 1/667* (2013.01); *C21D 9/573* (2013.01); *C22C 21/00* (2013.01); *C22F 1/002* (2013.01); *C22F 1/04* (2013.01)

(58) Field of Classification Search

CPC ..... C21D 9/5735

See application file for complete search history.

(56) References Cited

U.S. PATENT DOCUMENTS 4,710,240 A 12/1987 Frommann
5,676,767 A 10/1997 Liu et al.
(Continued)

*Primary Examiner* — Scott R Kastler
(74) *Attorney, Agent, or Firm* — Armstrong Teasdale LLP

(57) ABSTRACT

An apparatus (102) for processing a metal ribbon (116) comprising a main portion (118) and a sacrificial portion (120) adjoining the main portion (118) of the metal ribbon (116), is disclosed. The apparatus (102) comprises a heater (108), configured to heat the main portion (118) of the metal ribbon (116) to a first temperature, a first cooler (110), configured to cool the main portion (118) of the metal ribbon (116) from the first temperature to a third temperature lower than the first temperature, a second cooler (112), configured to cool the main portion (118) of the metal ribbon (116) at a first rate from the third temperature to a fourth temperature lower than the third temperature, a drive system (124), configured to successively advance the main portion (118) of the metal ribbon (116) from the heater (108) to the second cooler (112) through the first cooler (110), and a guide system (114) configured to route the metal ribbon (116) from the heater (108) to the second cooler (112) through the first cooler (110).

20 Claims, 8 Drawing Sheets

(51) Int. Cl.
*C21D 1/60* (2006.01)
*C21D 1/667* (2006.01)

(56) References Cited

U.S. PATENT DOCUMENTS

| | | | | |
|---|---|---|---|---|
| 9,708,686 | B2 * | 7/2017 | Porter | C21D 9/5735 |
| 2001/0000377 | A1 | 4/2001 | Matsuda et al. | |

* cited by examiner

APPARATUSES AND METHODS FOR PROCESSING A METAL RIBBON

CROSS REFERENCE TO RELATED APPLICATIONS

This application is a continuation and claims priority to U.S. patent application Ser. No. 14/588,637 filed May Jan. 2, 2015, and issued as U.S. Pat. No. 9,708,686 on Jul. 18, 2017, for "APPARATUSES AND METHODS FOR PROCESSING A METAL RIBBON", which is hereby incorporated by reference in its entirety.

BACKGROUND

Metallic ribbon, such as that made of aluminum, is typically used in aircraft construction to form components, such as stringers. Generally, the metallic ribbon undergoes a series of heat treatments (e.g., annealing and quenching) before being formed into predetermined shapes. Before being heat treated, the metallic ribbon is pre-formed, such that "waves" or "crinkles" are defined in the ribbon. The pre-formed ribbon is then wound onto large spools. The "waves" or "crinkles" in the metallic ribbon form gaps between adjacent layers of the wound material such that heat transfer to and from the ribbon is improved during heat-treating steps. Conventionally, spools of pre-formed metallic ribbon are individually transferred between the various pieces of heat-treating equipment, which can be a time-consuming and laborious task. Moreover, pre-forming the metallic ribbon substantially increases the diameter of wound spools. Accordingly, heat-treating equipment, such as furnaces and quench tanks, must be up-sized to accommodate the spools of pre-processed metallic ribbon, thus creating space and efficiency concerns.

SUMMARY

Accordingly, apparatuses and methods, intended to address the above-identified concerns, would find utility.

The following is a non-exhaustive list of examples, which may or may not be claimed, of the subject matter according the present disclosure.

One example of the present disclosure relates to an apparatus for processing a metal ribbon comprising a main portion and a sacrificial portion adjoining the main portion of the metal ribbon. The apparatus comprises a heater, configured to heat the main portion of the metal ribbon to a first temperature. The apparatus also comprises a first cooler, configured to cool the main portion of the metal ribbon from the first temperature to a third temperature lower than the first temperature. The apparatus further comprises a second cooler, configured to cool the main portion of the metal ribbon at a first rate from the third temperature to a fourth temperature lower than the third temperature. The apparatus additionally comprises a drive system, configured to successively advance the main portion of the metal ribbon from the heater to the second cooler through the first cooler. The apparatus further comprises and a guide system, configured to route the metal ribbon from the heater to the second cooler through the first cooler.

Another example of the present disclosure relates to a method of processing a metal ribbon using a heater, a first cooler, and a second cooler. The metal ribbon comprises a main portion and a sacrificial portion adjoining the main portion. The method comprises routing the sacrificial portion of the metal ribbon through a first cooler to a second cooler, heating the main portion of the metal ribbon to a first temperature in the heater, cooling the main portion of the metal ribbon from the first temperature to a third temperature lower than the first temperature while successively advancing the main portion of the metal ribbon from the heater to the second cooler through the first cooler, and cooling the main portion of the metal ribbon in the second cooler at a first rate from the third temperature to a fourth temperature lower than the third temperature.

BRIEF DESCRIPTION OF THE DRAWINGS

Having thus described examples of the present disclosure in general terms, reference will now be made to the accompanying drawings, which are not necessarily drawn to scale, and wherein like reference characters designate the same or similar parts throughout the several views, and wherein:

FIG. 1 is a block diagram of an apparatus for processing a metal ribbon, according to one or more examples of the present disclosure;

FIG. 2 is a schematic illustration of at least a portion of the apparatus of FIG. 1 during one stage of operation, according to one or more examples of the present disclosure;

FIG. 3 is a schematic illustration of at least a portion of the apparatus of FIG. 1 during another stage of operation, according to one or more examples of the present disclosure;

FIG. 4 is a schematic top view of the apparatus of FIG. 1, according to one or more examples of the present disclosure;

FIG. 5A is a first portion of a block diagram of a method of processing a metal ribbon, according to one or more examples of the present disclosure;

FIG. 5B is a second portion of the block diagram of the method of processing a metal ribbon, according to one or more examples of the present disclosure;

FIG. 6 is a block diagram of aircraft production and service methodology; and FIG. 7 is a schematic illustration of an aircraft.

DETAILED DESCRIPTION

Figure 1:
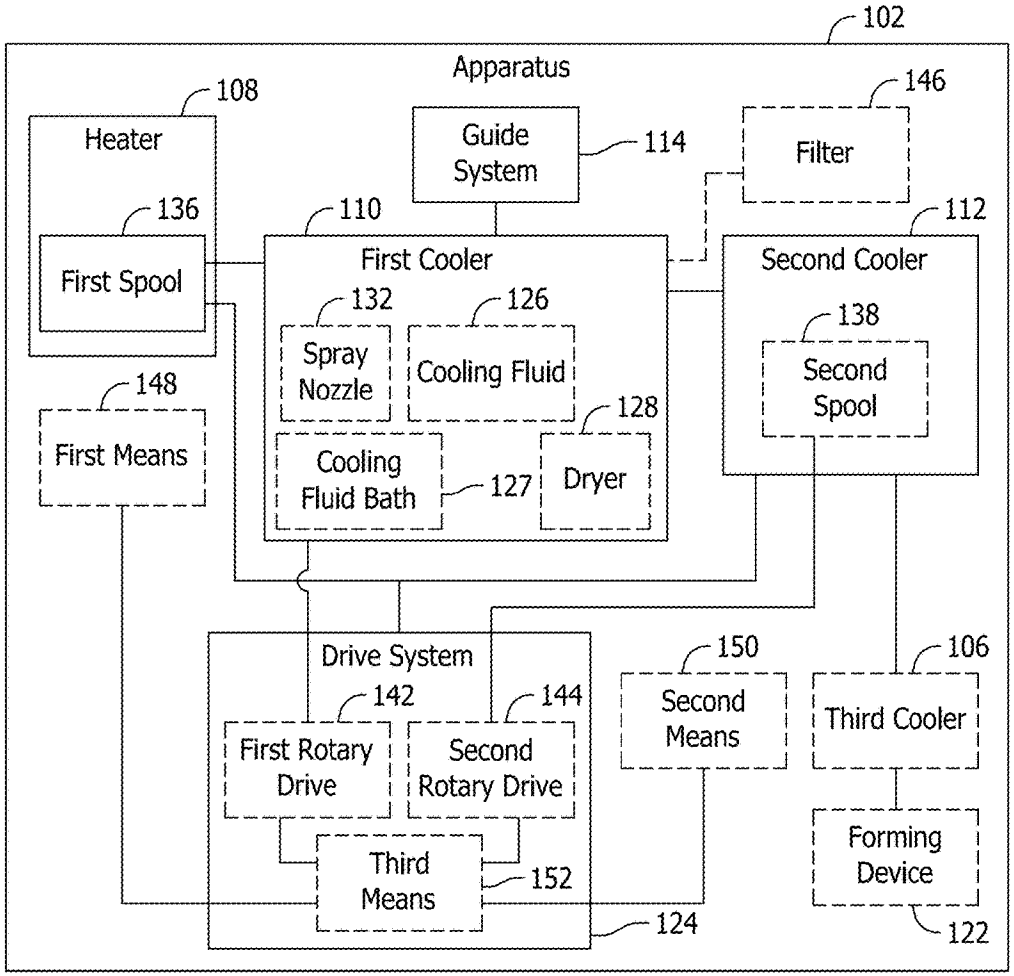

In FIG. 1, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting the various elements and/or components represent couplings similar in function and purpose to those represented by solid lines; however, couplings represented by the dashed lines may either be selectively provided or may relate to alternative or optional examples of the present disclosure. Likewise, elements and/or components, if any, represented with dashed lines, indicate alternative or optional examples of the present disclosure. Environmental elements, if any, are represented with dotted lines. Virtual imaginary elements may also be shown for clarity. Those skilled in the art will appreciate that some of the features illustrated in FIG. 1 may be combined in various ways without the need to include other features described in FIG. 1, other drawing figures, and/or the accompanying disclosure, even though such combination or combinations are not explicitly illustrated herein. Similarly, additional features not limited to the examples presented, may be combined with some or all of the features shown and described herein.

Figure 5A:
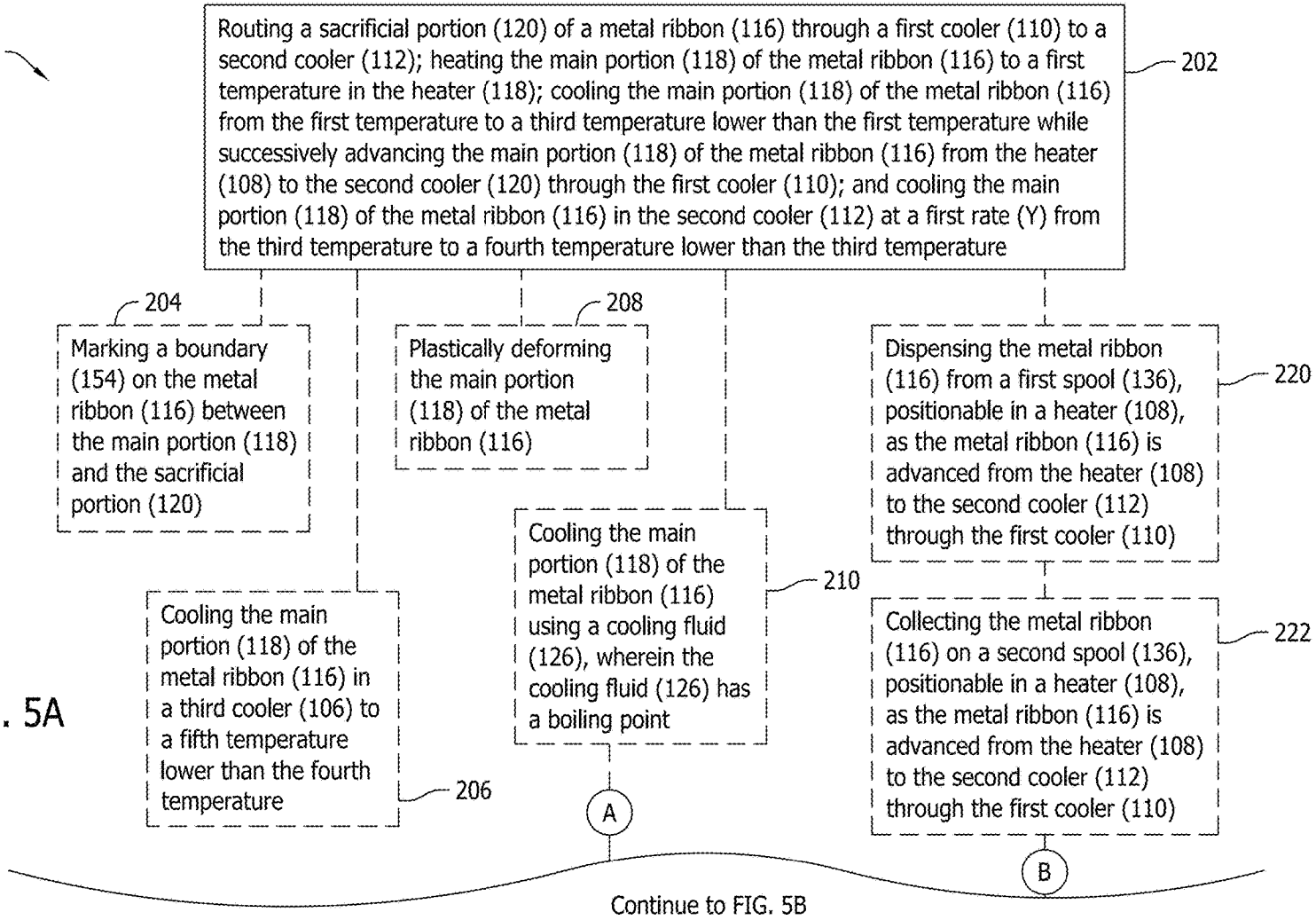
Figure 5B:
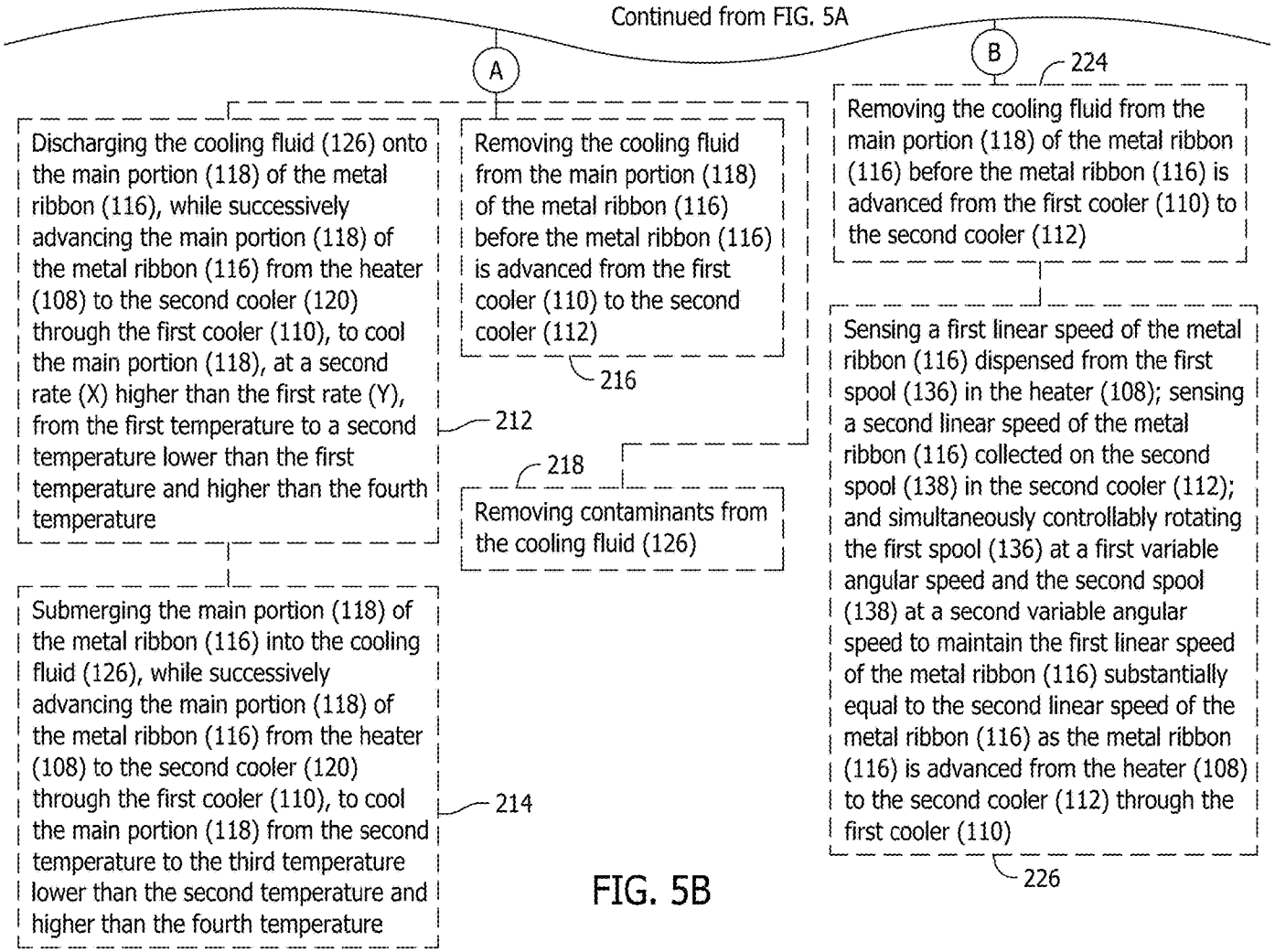

In FIGS. 5A and 5B, referred to above, the blocks may represent operations and/or portions thereof and lines connecting the various blocks do not imply any particular order or dependency of the operations or portions thereof. It will be understood that not all dependencies among the various disclosed operations are necessarily represented. FIGS. 5A and 5B and the accompanying disclosure describing the operations of the methods set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

Illustrative, non-exhaustive examples, which may or may not be claimed, of the subject matter according the present disclosure are provided below.

Figure 2:
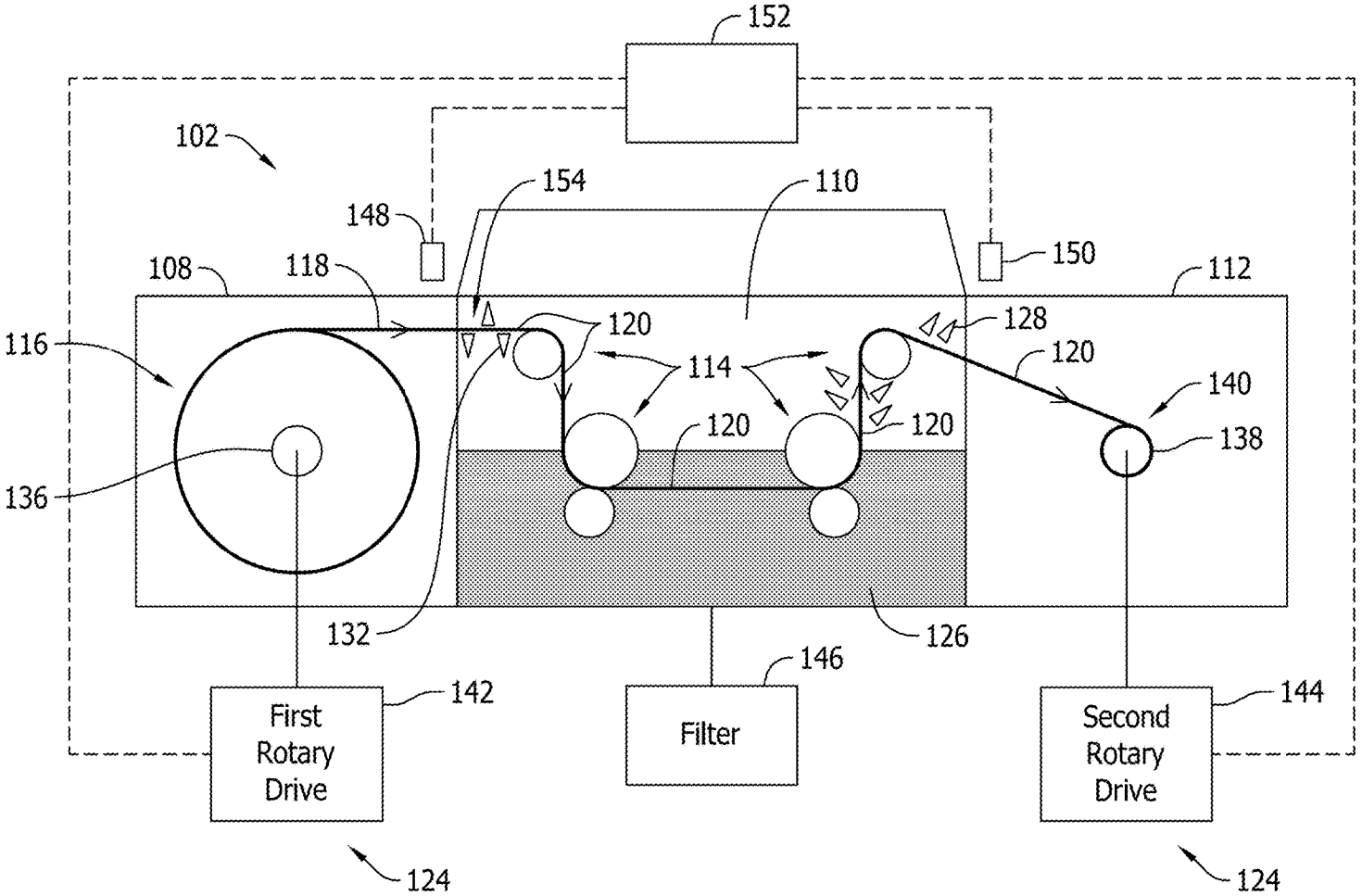
Figure 3:
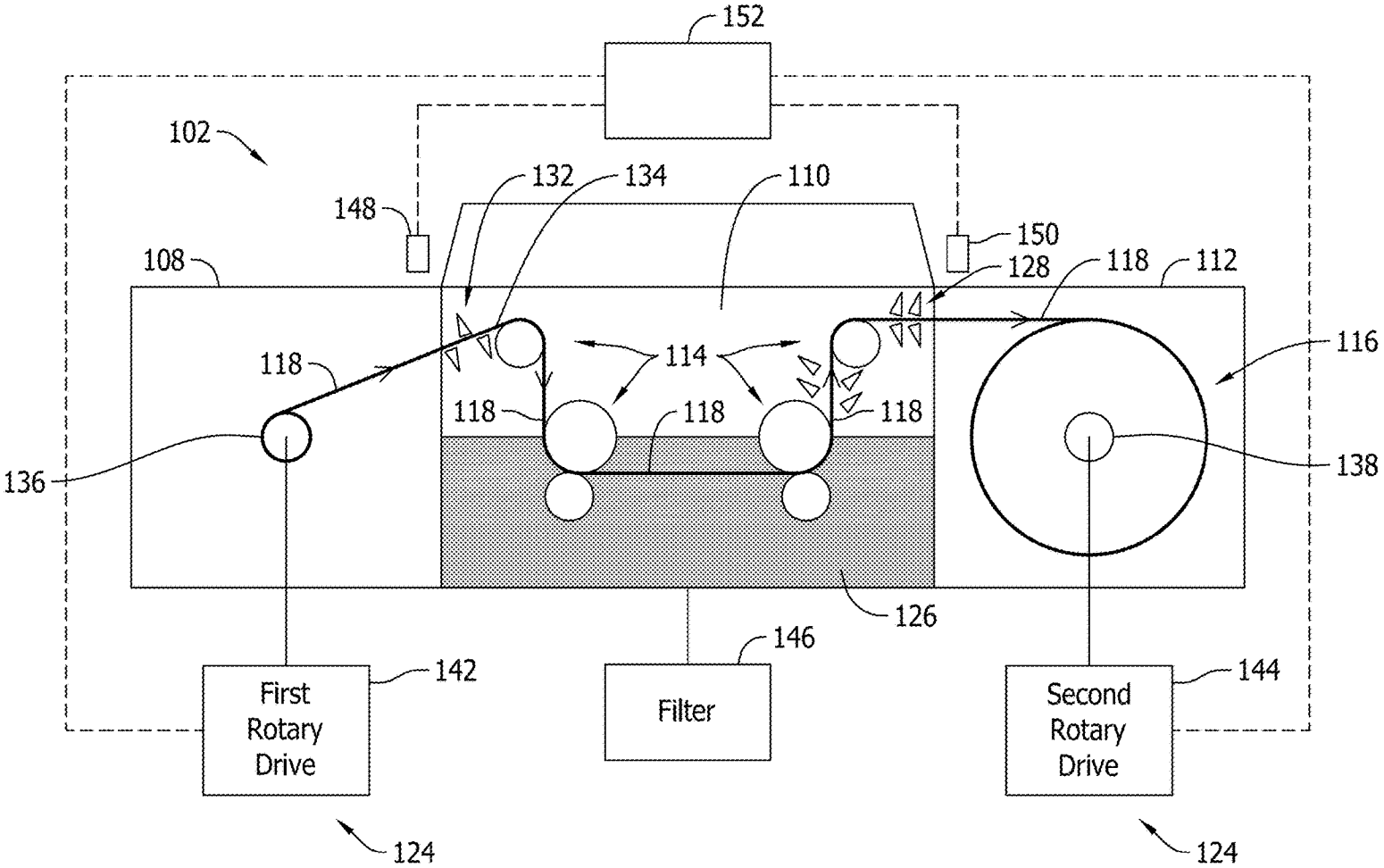

Referring e.g., to FIGS. 1-3, apparatus 102 for processing metal ribbon 116 comprising main portion 118 and sacrificial portion 120 adjoining main portion 118 of metal ribbon 116, is disclosed. Apparatus 102 comprises heater 108, configured to heat main portion 118 of metal ribbon 116 to a first temperature. Apparatus 102 also comprises first cooler 110, configured to cool main portion 118 of metal ribbon 116 from the first temperature to a third temperature lower than the first temperature. Apparatus 102 further comprises second cooler 112, configured to cool main portion 118 of metal ribbon 116 at a first rate from the third temperature to a fourth temperature lower than the third temperature. Apparatus 102 additionally comprises drive system 124, configured to successively advance main portion 118 of metal ribbon 116 from heater 108 to second cooler 112 through first cooler 110. Apparatus 102 further comprises guide system 114, configured to route metal ribbon 116 from heater 108 to second cooler 112 through first cooler 110. The preceding subject matter of the instant paragraph is in accordance with example 1 of the present disclosure.

Successively advancing metal ribbon 116 from heater 108 to second cooler 112 through first cooler 110 enables single layers of metal ribbon 116 discharged from heater 108 to be continuously processed, which eliminates the need to preform metal ribbon 116 with "waves." As such, the size of heater 108, first cooler 110, and second cooler 112 can be reduced.

Heater 108 heats main portion 118 of metal ribbon 116 for a duration at the first temperature to ensure main portion 118 is thoroughly soaked with heat before being advanced to second cooler 112 through first cooler 110. For example, in one implementation, main portion 118 is heated for up to about two hours at a temperature of at least about 850° F.

Guide system 114 includes a plurality of rollers that facilitate routing metal ribbon 116 from heater 108 to second cooler 112 through first cooler 110. The rollers are positioned such that metal ribbon 116 routed with guide system 114 has less than a 90° directional change between adjacent rollers. As such, work hardening of metal ribbon 116 is reduced.

Figure 4:
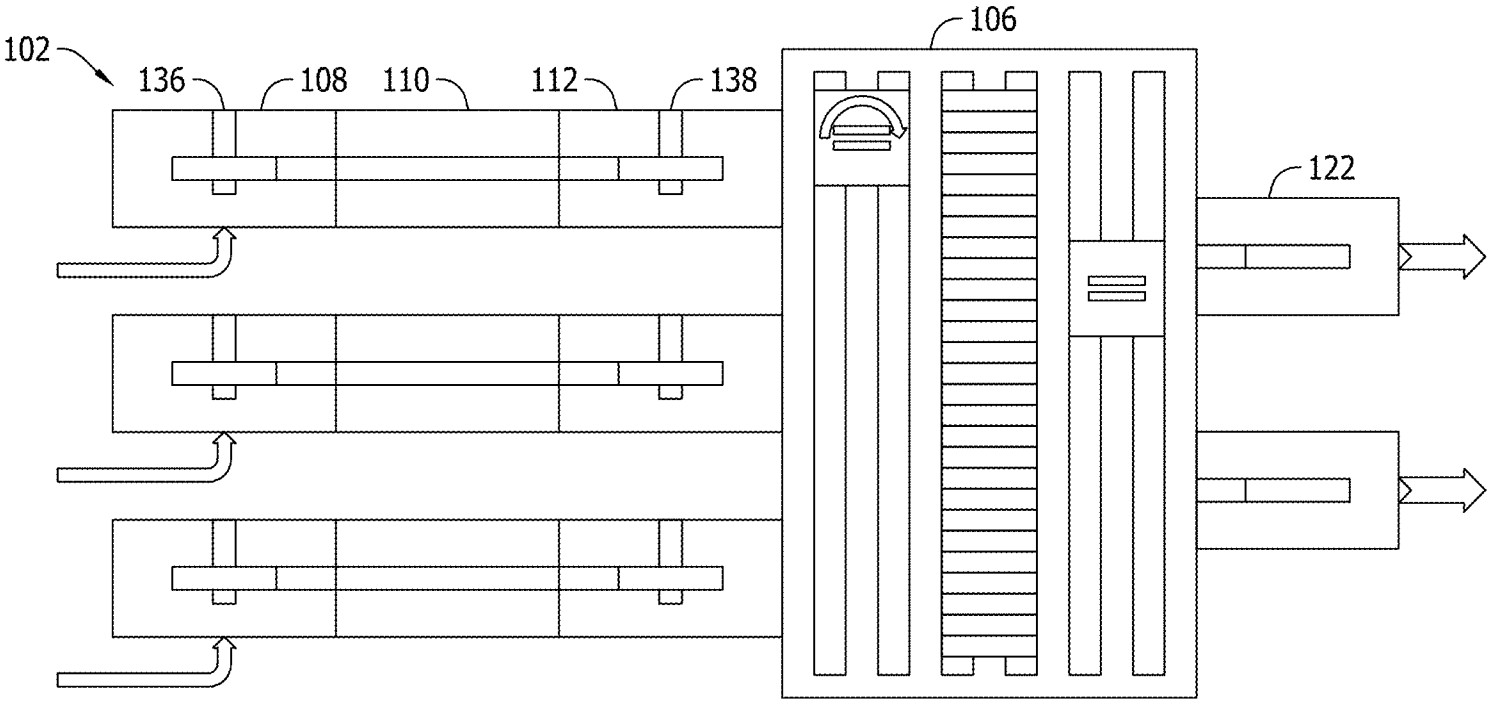

Referring generally to FIG. 1, and particularly to e.g., FIG. 4, apparatus 102 further comprises third cooler 106 in selective communication with second cooler 112. Third cooler 106 is configured to cool main portion 118 of metal ribbon 116 to a fifth temperature lower than the fourth temperature. The preceding subject matter of the instant paragraph is in accordance with example 2 of the present disclosure, and example 2 includes the subject matter of example 1, above.

Cooling main portion 118 of metal ribbon 116 at the fifth temperature enables main portion 118 to retain its physical properties induced by the processing steps described above for extended periods of time. For example, in one implementation, storing main portion 118 of metal ribbon 116 at the fifth temperature enables the physical properties to be retained for up to about one month. Moreover, having third cooler 106 in selective communication with second cooler 112 enables metal ribbon 116 to be easily transferred from second cooler 112 to third cooler 106 after metal ribbon 116 has been collected within second cooler 112. In one implementation, the fifth temperature is less than about −20° F.

Referring generally to FIG. 1, and particularly to e.g., FIG. 4, apparatus 102 further comprises forming device 122 configured to plastically deform main portion 118 of metal ribbon 116. Forming device 122 is in selective communication with third cooler 106. The preceding subject matter of the instant paragraph is in accordance with example 3 of the present disclosure, and example 3 includes the subject matter of example 2, above.

Forming device 122 facilitates forming main portion 118 of metal ribbon 116 into predetermined shapes for use in manufacturing an aircraft (not shown), for example. Moreover having forming device 122 in selective communication with third cooler 106 enables metal ribbon 116 to be easily transferred from third cooler 106 to forming device 122. Forming device 122 may be embodied as a yoder, or any device capable of mechanically deforming main portion 118 of metal ribbon 116.

Referring generally to FIG. 1, and particularly to e.g., FIGS. 2 and 3, first cooler 110 is configured to cool main portion 118 of metal ribbon 116 to the third temperature with cooling fluid 126. Cooling fluid 126 has a boiling point. The preceding subject matter of the instant paragraph is in accordance with example 4 of the present disclosure, and example 4 includes the subject matter of any of examples 1-3, above.

Cooling main portion 118 of metal ribbon 116 with cooling fluid 126 facilitates rapidly cooling main portion 118 of metal ribbon 116, such that a hardness of main portion 118 is increased. An exemplary cooling fluid 126 includes, but is not limited to, water, having a boiling point of 100° C. (212° F.) at atmospheric pressure.

Referring generally to FIG. 1, and particularly to e.g., FIGS. 2 and 3, first cooler 110 comprises spray nozzle 132 configured to discharge cooling fluid 126 onto main portion 118 of metal ribbon 116 and to cool main portion 118 at a second rate higher than the first rate from the first temperature to a second temperature lower than the first temperature and higher than the fourth temperature. The preceding subject matter of the instant paragraph is in accordance with example 5 of the present disclosure, and example 5 includes the subject matter of example 4, above.

Discharging cooling fluid 126 onto main portion 118 of metal ribbon 116 cools metal ribbon 116 prior to being submerged within cooling fluid bath 127 such that the second temperature is closer to the boiling point of cooling fluid 126 than the first temperature. As such, an amount of cooling fluid 126 within cooling fluid bath 127 that vaporizes when contacted by main portion 118 of metal ribbon 116 is reduced, which reduces the likelihood of a vapor barrier (not shown) restricting contact between metal ribbon 116 and cooling fluid 126 in cooling fluid bath 127.

Referring generally to FIG. 1, and particularly to e.g., FIGS. 2 and 3, the second temperature is lower than the boiling point of cooling fluid 126. The preceding subject matter of the instant paragraph is in accordance with example 6 of the present disclosure, and example 6 includes the subject matter of example 5, above.

As described above, having the second temperature lower than the boiling point of cooling fluid 126 reduces vaporization of cooling fluid 126 within cooling fluid bath 127 when contacted by main portion 118 of metal ribbon 116.

Referring generally to FIG. 1, and particularly to e.g., FIGS. 2 and 3, apparatus 102 further comprises cooling fluid bath 127 configured to submerge main portion 118 of metal ribbon 116 in cooling fluid 126 to cool main portion 118 from the second temperature to the third temperature lower than the second temperature and higher than the fourth temperature. The preceding subject matter of the instant paragraph is in accordance with example 7 of the present disclosure, and example 7 includes the subject matter of any of examples 5-6, above.

As described above, cooling main portion 118 of metal ribbon 116 with cooling fluid 126 and, more specifically, submerging main portion 118 of metal ribbon 116 in cooling fluid 126 facilitates rapidly cooling main portion 118 of metal ribbon 116, such that a hardness of main portion 118 is increased.

Referring generally to FIG. 1, and particularly to e.g., FIGS. 2 and 3, apparatus 102 further comprises dryer 128 configured to remove cooling fluid 126 from main portion 118 of metal ribbon 116 before metal ribbon 116 is advanced from first cooler 110 to second cooler 112. The preceding subject matter of the instant paragraph is in accordance with example 8 of the present disclosure, and example 8 includes the subject matter of any of examples 4-7, above.

The fourth temperature in second cooler 112 is generally lower than a freezing point of cooling fluid 126. As such, removing cooling fluid 126 from main portion 118 of metal ribbon 116 before being advanced to second cooler 112 reduces adhesion between layers of metal ribbon 116 spooled within second cooler 112 via freezing.

Dryer 128 may be embodied as at least one of a blower that discharges pressurized air towards main portion 118 of metal ribbon 116, or a physical removal device such as a squeegee.

Referring generally to FIG. 1, and particularly to e.g., FIGS. 2 and 3, apparatus 102 further comprises filter 146 configured to remove contaminants from cooling fluid 126 in first cooler 110. The preceding subject matter of the instant paragraph is in accordance with example 9 of the present disclosure, and example 9 includes the subject matter of any of examples 4-8, above.

Removing contaminants from cooling fluid 126 reduces contamination of main portion 118 of metal ribbon 116 being successively advanced through cooling fluid bath 127.

Filter 146 either operates continuously, or is selectively operable based on an output from a sensor (not shown) within cooling fluid bath 127. More specifically, the output generated by the sensor includes a contamination level of cooling fluid bath 127 and, in one implementation, filter 146 operates when the contamination level is greater than a predetermined threshold.

Referring generally to FIG. 1, and particularly to e.g., FIGS. 2 and 3, drive system 124 comprises second rotary drive 144 in communication with second cooler 112. Second rotary drive 144 is selectively operable to successively advance main portion 118 of metal ribbon 116 from heater 108 to second cooler 112 through first cooler 110. The preceding subject matter of the instant paragraph is in accordance with example 10 of the present disclosure, and example 10 includes the subject matter of any of examples 1-9, above.

Second rotary drive 144 enables metal ribbon 116 to be pulled from heater 108, through first cooler 110, and into second cooler 112.

Referring generally to FIG. 1, and particularly to e.g., FIGS. 2-4, apparatus 102 further comprises second spool 138 positionable in second cooler 112 to engage second rotary drive 144. Second spool 138 is configured to collect metal ribbon 116 advanced from heater 108 to second cooler 112 through first cooler 110. The preceding subject matter of the instant paragraph is in accordance with example 11 of the present disclosure, and example 11 includes the subject matter of example 10, above.

Second spool 138 is rotatable to enable metal ribbon 116 to be collected in an efficient and space-saving manner.

In one implementation, second spool 138 is selectively engaged with an expandable chuck (not shown) that ensures second spool 138 remains secure within second cooler 112.

Referring generally to FIG. 1, and particularly to e.g., FIGS. 2 and 3, drive system 124 further comprises first rotary drive 142 in communication with heater 108. The preceding subject matter of the instant paragraph is in accordance with example 12 of the present disclosure, and example 12 includes the subject matter of example 11, above.

First rotary drive 142 operates to reduce tension in metal ribbon 116 advanced from heater 108, and being pulled through first cooler 110 into second cooler 112 to by second rotary drive 144.

Referring generally to FIG. 1, and particularly to e.g., FIGS. 2-4, apparatus 102 further comprises first spool 136 positionable in heater 108 to engage first rotary drive 142. First spool 136 is configured to dispense metal ribbon 116 advanced from heater 108 to second cooler 112 through first cooler 110. The preceding subject matter of the instant paragraph is in accordance with example 13 of the present disclosure, and example 13 includes the subject matter of example 12, above.

First spool 136 is rotatable to enable metal ribbon 116 to be dispensed continuously from heater 108 to second cooler 112 through first cooler 110.

In one implementation, first spool 136 is selectively engaged with an expandable chuck (not shown) that ensures first spool 136 remains secure within second cooler 112.

Referring generally to FIG. 1, and particularly to e.g., FIGS. 2 and 3, first rotary drive 142 and second rotary drive 144 are simultaneously controllably operable to maintain a constant tension in metal ribbon 116 extending between first spool 136 and second spool 138 as metal ribbon 116 is advanced from heater 108 to second cooler 112 through first cooler 110. The preceding subject matter of the instant paragraph is in accordance with example 14 of the present disclosure, and example 14 includes the subject matter of example 13, above.

Maintaining the constant tension in metal ribbon 116 reduces deformation of metal ribbon 116 when compared to a tension in metal ribbon 116 if first rotary drive 142 and second rotary drive 144 operated independently of each other.

Referring generally to FIG. 1, and particularly to e.g., FIGS. 2 and 3, apparatus 102 further comprises first means 148 for sensing a first linear speed of metal ribbon 116 dispensed from first spool 136 in heater 108. Apparatus 102 also comprises second means 150 for sensing a second linear speed of metal ribbon 116 collected on second spool 138 in second cooler 112. Apparatus 102 additionally comprises third means 152 for simultaneously controllably operating first rotary drive 142 at a first variable angular speed and second rotary drive 144 at a second variable angular speed to maintain the first linear speed of metal ribbon 116 substantially equal to the second linear speed of metal ribbon 116 as metal ribbon 116 is advanced from heater 108 to second cooler 112 through first cooler 110. The preceding subject matter of the instant paragraph is in accordance with example 15 of the present disclosure, and example 15 includes the subject matter of any of examples 13-14, above.

Controlling the first and second variable angular speeds to maintain the first and second linear speeds of metal ribbon 116 to be substantially equal facilitates maintaining constant tension in metal ribbon 116, and thus reduces deformation of metal ribbon 116.

First means 148 and second means 150 include a laser surface velocimeter, a radar surface velocimeter, an optical sensor, a sonic sensor, an indexed sensor, an infrared sensor, or an ultraviolet sensor. Third means 152 includes an electronic device such as a controller including a memory and a processor coupled to memory for executing programmed instructions. The controller is programmable to perform one or more operations described herein by programming the memory and/or the processor. For example, the processor may be programmed by encoding an operation as executable instructions and providing the executable instructions in memory.

In operation, first means 148 provides a first output to third means 152 that includes the first linear speed of metal ribbon 116 dispensed from first spool 136, and second means 150 provides a second output to third means 152 that includes the second linear speed of metal ribbon 116 collected on second spool 138. Based on the first and second outputs received from first means 148 and second means 150, third means 152 transmits a first speed input to first rotary drive 142 and a second speed input to second rotary drive 144. The first speed input directs first rotary drive 142 to operate at the first variable angular speed and the second speed input directs second rotary drive 144 to operate at the second variable angular speed. The first and second speed inputs are selected such that the first linear speed and the second linear speed are substantially equal.

As used herein, any means-plus-function clause is to be interpreted under 35 U.S.C. 112(f), unless otherwise explicitly stated. It should be noted that examples provided herein of any structure, material, or act in support of any means-plus-function clause, and equivalents thereof, may be utilized individually or in combination. Thus, while various structures, materials, or acts may be described in connection with a means-plus-function clause, any combination thereof or of their equivalents is contemplated in support of such means-plus-function clause.

Referring generally to FIGS. 1-3, and particularly to FIGS. 5A and 5B (block 202), method 200 of processing metal ribbon 116 using heater 108, first cooler 110, and second cooler 112 is disclosed. Metal ribbon 116 comprises main portion 118 and sacrificial portion 120 adjoining main portion 118. Method 200 comprises routing sacrificial portion 120 of metal ribbon 116 through first cooler 110 to second cooler 112, heating main portion 118 of metal ribbon 116 to a first temperature in heater 108, cooling main portion 118 of metal ribbon 116 from the first temperature to a third temperature lower than the first temperature while successively advancing main portion 118 of metal ribbon 116 from heater 108 to second cooler 120 through first cooler 110, and cooling main portion 118 of metal ribbon 116 in second cooler 112 at a first rate from the third temperature to a fourth temperature lower than the third temperature. The preceding subject matter of the instant paragraph is in accordance with example 16 of the present disclosure.

Sacrificial portion 120 is routed to second cooler 112 before heating main portion 118 of metal ribbon 116 to enable metal ribbon 116 to be continuously processed once main portion 118 has been thoroughly heat soaked.

Referring generally to FIGS. 1-3, and particularly to FIGS. 5A and 5B (block 204), method 200 further comprises marking boundary 154 on metal ribbon 116 between main portion 118 and sacrificial portion 120. The preceding subject matter of the instant paragraph is in accordance with example 17 of the present disclosure, and example 17 includes the subject matter of example 16, above.

Marking 204 boundary 154 enables easy determination of portions of metal ribbon 116 that have been processed and may be used to manufacture the aircraft, for example, and enables determination of portions of metal ribbon 116 that have not been processed and can be discarded.

Referring generally to FIGS. 1-3, and particularly to FIGS. 5A and 5B (block 206), method 200 further comprises cooling main portion 118 of metal ribbon 116 in third cooler 106 to a fifth temperature lower than the fourth temperature. The preceding subject matter of the instant paragraph is in accordance with example 18 of the present disclosure, and example 18 includes the subject matter of any of examples 16-17, above.

Cooling main portion 118 of metal ribbon 116 at the fifth temperature enables main portion 118 to retain its physical properties induced by the processing steps described above for extended periods of time. For example, in one implementation, storing main portion 118 of metal ribbon 116 at the fifth temperature enables the physical properties to be retained for up to about one month. Moreover, having third cooler 106 in selective communication with second cooler 112 enables metal ribbon 116 to be easily transferred from second cooler 112 to third cooler 106 after metal ribbon 116 has been collected within second cooler 112. In one implementation, the fifth temperature is less than about −20° F.

Referring generally to FIGS. 1-3, and particularly to FIGS. 5A and 5B (block 208), method 200 further comprises plastically deforming main portion 118 of metal ribbon 116.

The preceding subject matter of the instant paragraph is in accordance with example 19 of the present disclosure, and example 19 includes the subject matter of any of examples 16-18, above.

Main portion 118 of metal ribbon 116 is plastically deformed after being advanced to second cooler 112 such that metal ribbon 116 used to form components for the aircraft, for example, includes the physical properties induced by the processing steps described above.

Referring generally to FIGS. 1-3, and particularly to FIGS. 5A and 5B (block 210), cooling main portion 118 of metal ribbon 116 from the first temperature to the third temperature comprises cooling main portion 118 of metal ribbon 116 using cooling fluid 126. Cooling fluid 126 has a boiling point. The preceding subject matter of the instant paragraph is in accordance with example 20 of the present disclosure, and example 20 includes the subject matter of any of examples 16-19, above.

Cooling main portion 118 of metal ribbon 116 with cooling fluid 126 facilitates rapidly cooling main portion 118 of metal ribbon 116, such that a hardness of main portion 118 is increased.

Referring generally to FIGS. 1-3, and particularly to FIGS. 5A and 5B (block 212), method 200 further comprises discharging cooling fluid 126 onto main portion 118 of metal ribbon 116, while successively advancing main portion 118 of metal ribbon 116 from heater 108 to second cooler 120 through first cooler 110, to cool main portion 118, at a second rate higher than the first rate, from the first temperature to a second temperature lower than the first temperature and higher than the fourth temperature. The preceding subject matter of the instant paragraph is in accordance with example 21 of the present disclosure, and example 21 includes the subject matter of example 20, above.

Discharging cooling fluid 126 onto main portion 118 of metal ribbon 116 cools metal ribbon 116 prior to being submerged within cooling fluid bath 127 such that the second temperature is closer to the boiling point of cooling fluid 126 than the first temperature. As such, an amount of cooling fluid 126 within cooling fluid bath 127 that vaporizes when contacted by main portion 118 of metal ribbon 116 is reduced, which reduces the likelihood of a vapor barrier (not shown) restricting contact between metal ribbon 116 and cooling fluid 126 in cooling fluid bath 127.

Referring generally to FIGS. 1-3, and particularly to FIGS. 5A and 5B, the second temperature is lower than the boiling point of the cooling fluid 126. The preceding subject matter of the instant paragraph is in accordance with example 22 of the present disclosure, and example 22 includes the subject matter of example 21, above.

As described above, having the second temperature lower than the boiling point of cooling fluid 126 reduces vaporization of cooling fluid 126 within cooling fluid bath 127 when contacted by main portion 118 of metal ribbon 116.

Referring generally to FIGS. 1-3, and particularly to FIGS. 5A and 5B (block 214), method 200 further comprises submerging main portion 118 of metal ribbon 116 into cooling fluid 126, while successively advancing main portion 118 of metal ribbon 116 from heater 108 to second cooler 120 through first cooler 110, to cool main portion 118 from the second temperature to the third temperature lower than the second temperature and higher than the fourth temperature. The preceding subject matter of the instant paragraph is in accordance with example 23 of the present disclosure, and example 23 includes the subject matter of any of examples 21-22, above.

As described above, cooling main portion 118 of metal ribbon 116 with cooling fluid 126 and, more specifically, submerging main portion 118 of metal ribbon 116 in cooling fluid 126 facilitates rapidly cooling main portion 118 of metal ribbon 116, such that a hardness of main portion 118 is increased.

Referring generally to FIGS. 1-3, and particularly to FIGS. 5A and 5B (block 216), method 200 further comprises removing cooling fluid 126 from main portion 118 of metal ribbon 116 before metal ribbon 116 is advanced from first cooler 110 to second cooler 112. The preceding subject matter of the instant paragraph is in accordance with example 24 of the present disclosure, and example 24 includes the subject matter of any of examples 20-23, above.

The fourth temperature in second cooler 112 is generally lower than a freezing point of cooling fluid 126. As such, removing cooling fluid 126 from main portion 118 of metal ribbon 116 before being advanced to second cooler 112 reduces adhesion between layers of metal ribbon 116 spooled within second cooler 112 via freezing.

Referring generally to FIGS. 1-3, and particularly to FIGS. 5A and 5B (block 218), method 200 further comprises removing contaminants from cooling fluid 126. The preceding subject matter of the instant paragraph is in accordance with example 25 of the present disclosure, and example 25 includes the subject matter of any of examples 20-24, above.

Removing contaminants from cooling fluid 126 reduces contamination of main portion 118 of metal ribbon 116 being successively advanced through cooling fluid bath 127.

The contaminants may be removed continuously or selectively based on an output from a sensor (not shown) within cooling fluid bath 127. More specifically, the output generated by the sensor includes a contamination level in cooling fluid bath 127 and, in one implementation, contaminants are removed when the contamination level is greater than a predetermined threshold.

Referring generally to FIGS. 1-3, and particularly to FIGS. 5A and 5B (block 220), method 200 further comprises dispensing metal ribbon 116 from first spool 136, positionable in heater 108, as metal ribbon 116 is advanced from heater 108 to second cooler 112 through first cooler 110. The preceding subject matter of the instant paragraph is in accordance with example 26 of the present disclosure, and example 26 includes the subject matter of any of examples 16-25, above.

First spool 136 is rotatable to enable metal ribbon 116 to be dispensed continuously from heater 108 to second cooler 112 through first cooler 110.

In one implementation, first spool 136 is selectively engaged with an expandable chuck (not shown) that ensures first spool 136 remains secure within second cooler 112.

Referring generally to FIGS. 1-3, and particularly to FIGS. 5A and 5B (block 222), method 200 further comprises collecting metal ribbon 116 on second spool 138 positionable in second cooler 112 as metal ribbon 116 is advanced from heater 108 to second cooler 112 through first cooler 110. The preceding subject matter of the instant paragraph is in accordance with example 27 of the present disclosure, and example 27 includes the subject matter of example 26, above.

Second spool 138 is rotatable to enable metal ribbon 116 to be collected in an efficient and space-saving manner.

In one implementation, second spool 138 is selectively engaged with an expandable chuck (not shown) that ensures second spool 138 remains secure within second cooler 112.

Referring generally to FIGS. 1-3, and particularly to FIGS. 5A and 5B (block 224), method 200 further comprises maintaining a constant tension in metal ribbon 116 as metal ribbon 116 is advanced from heater 108 to second cooler 112 through first cooler 110. The preceding subject matter of the instant paragraph is in accordance with example 28 of the present disclosure, and example 28 includes the subject matter of example 27, above.

Maintaining the constant tension in metal ribbon 116 reduces deformation of metal ribbon 116 when compared to a tension in metal ribbon 116 if first rotary drive 142 and second rotary drive 144 operated independently of each other.

Referring generally to FIGS. 1-3, and particularly to FIGS. 5A and 5B (block 226), method 200 further comprises sensing a first linear speed of metal ribbon 116 dispensed from first spool 136 in heater 108, sensing a second linear speed of metal ribbon 116 collected on second spool 138 in second cooler 112, and simultaneously controllably rotating first spool 136 at a first variable angular speed and second spool 138 at a second variable angular speed to maintain the first linear speed of metal ribbon 116 substantially equal to the second linear speed of metal ribbon 116 as metal ribbon 116 is advanced from heater 108 to second cooler 112 through first cooler 110. The preceding subject matter of the instant paragraph is in accordance with example 29 of the present disclosure, and example 29 includes the subject matter of example 28, above.

Sensing the first and second linear speeds provides real-time feedback to ensure tension in metal ribbon 116 is maintained substantially constant. For example, the first and second linear speeds may be used to control the rotational speeds of first spool 136 and second spool 138, wherein the rotational speeds will vary based on an amount of metal ribbon 116 wound on first spool 136 and second spool 138.

Figure 6:
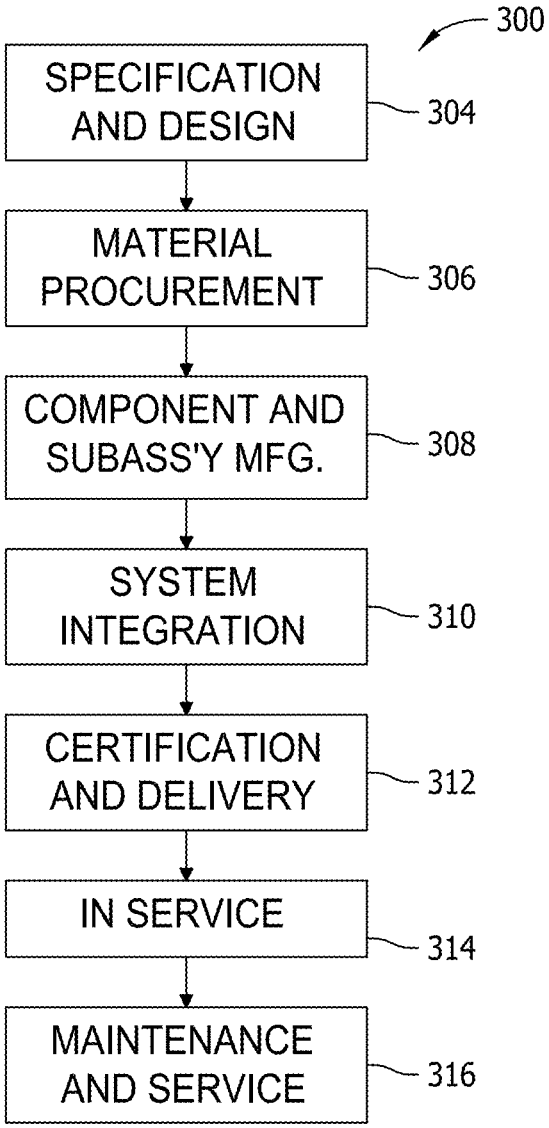
Figure 7:
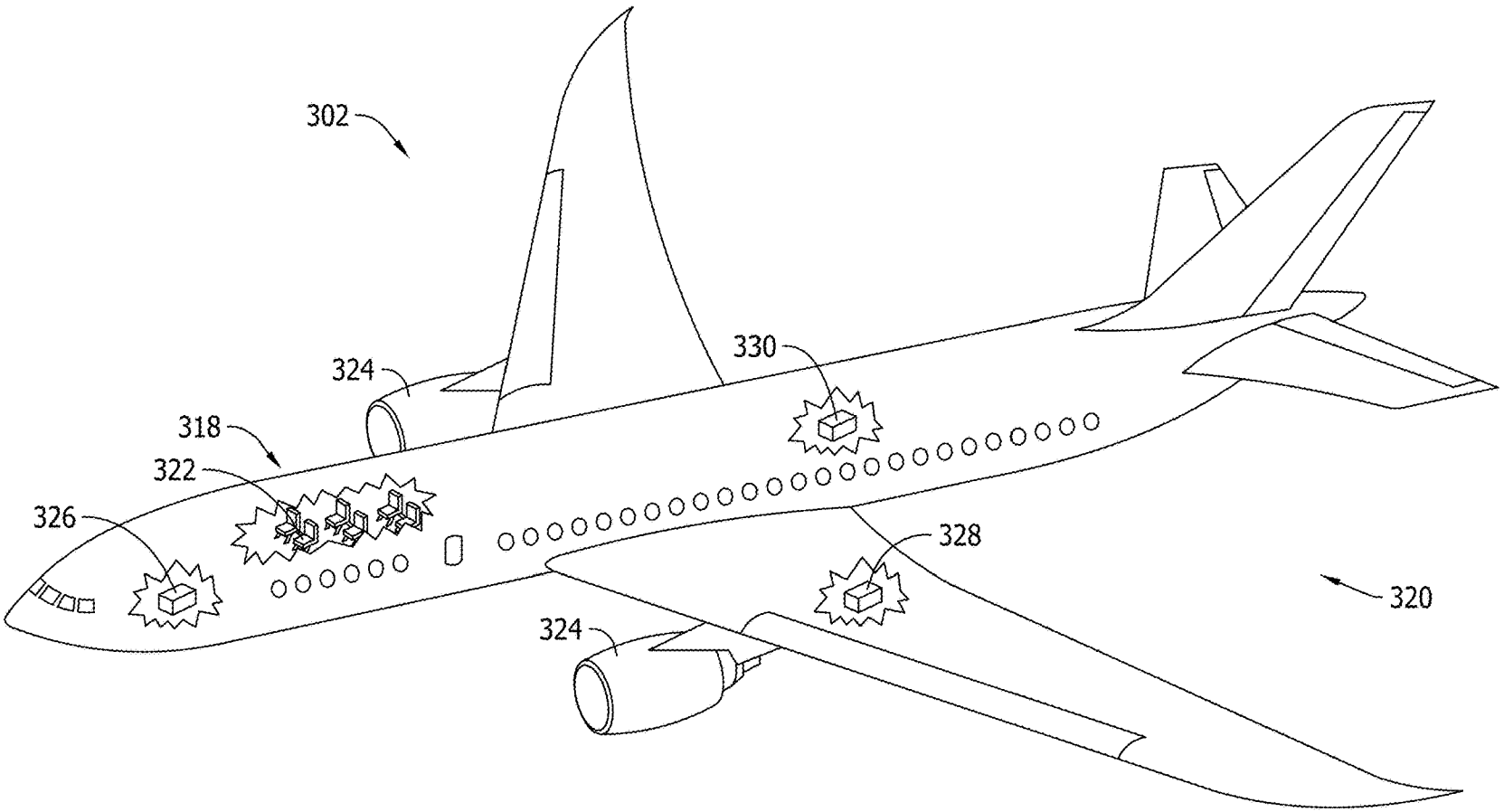

Examples of the present disclosure may be described in the context of aircraft manufacturing and service method 300 as shown in FIG. 6 and aircraft 302 as shown in FIG. 7. During pre-production, illustrative method 300 may include specification and design (block 304) of aircraft 302 and material procurement (block 306). During production, component and subassembly manufacturing (block 308) and system integration (block 310) of aircraft 302 may take place. Thereafter, aircraft 302 may go through certification and delivery (block 312) to be placed in service (block 314). While in service, aircraft 302 may be scheduled for routine maintenance and service (block 316). Routine maintenance and service may include modification, reconfiguration, refurbishment, etc. of one or more systems of aircraft 302.

Each of the processes of illustrative method 300 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 7, aircraft 302 produced by illustrative method 300 may include airframe 318 with a plurality of high-level systems 320 and interior 322. Examples of high-level systems 320 include one or more of propulsion system 324, electrical system 326, hydraulic system 328, and environmental system 330. Any number of other systems may be included. Although an aerospace example is shown, the principles disclosed herein may be applied to other industries, such as the automotive industry. Accordingly, in addition to aircraft 302, the principles disclosed herein may apply to other vehicles, e.g., land vehicles, marine vehicles, space vehicles, etc.

Apparatus(es) and method(s) shown or described herein may be employed during any one or more of the stages of the manufacturing and service method 300. For example, components or subassemblies corresponding to component and subassembly manufacturing (block 308) may be fabricated or manufactured in a manner similar to components or subassemblies produced while aircraft 302 is in service (block 314). Also, one or more examples of the apparatus(es), method(s), or combination thereof may be utilized during production stages 308 and 310, for example, by substantially expediting assembly of or reducing the cost of aircraft 302. Similarly, one or more examples of the apparatus or method realizations, or a combination thereof, may be utilized, for example and without limitation, while aircraft 302 is in service (block 314) and/or during maintenance and service (block 316).

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the spirit and scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples presented and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims.

What is claimed is:

1. An apparatus for processing a metal ribbon comprising a main portion and a sacrificial portion adjoining the main portion, the apparatus comprising:

a heater configured to heat the main portion of the metal ribbon to a first temperature;

a first cooler comprising a cooling fluid bath configured to cool the main portion of the metal ribbon at a first rate from the first temperature to a third temperature lower than the first temperature;

a second cooler configured to cool the main portion of the metal ribbon at a second rate from the third temperature to a fourth temperature lower than the third temperature, wherein the first rate is higher than the second rate;

a drive system configured to successively advance the main portion of the metal ribbon from the heater to the second cooler through the first cooler; and a guide system configured to route the metal ribbon from the heater, through the first cooler, and then to the second cooler such that the main portion of the metal ribbon is collected within the second cooler.

2. The apparatus in accordance with claim 1, wherein the first cooler is configured to cool the main portion of the metal ribbon to the third temperature with a cooling fluid, wherein the cooling fluid has a boiling point.

3. The apparatus in accordance with claim 2, wherein the first cooler comprises a spray nozzle configured to discharge the cooling fluid onto the main portion of the metal ribbon and to cool the main portion from the first temperature to a second temperature lower than the first temperature and higher than the fourth temperature.

4. The apparatus in accordance with claim 3, wherein the first cooler is configured to cool the main portion of the metal ribbon to the second temperature that is lower than the boiling point of the cooling fluid.

5. The apparatus in accordance with claim 3, wherein the cooling fluid bath is configured to submerge the main portion of the metal ribbon in the cooling fluid to cool the main portion from the second temperature to the to the third temperature lower than the second temperature and higher than the fourth temperature.

6. The apparatus in accordance with claim 1, wherein:

the drive system comprises a second rotary drive in communication with the second cooler; and the second rotary drive is selectively operable to successively advance the main portion of the metal ribbon from the heater to the second cooler through the first cooler.

7. The apparatus in accordance with claim 6, wherein the drive system further comprises a first rotary drive in communication with the heater.

8. The apparatus in accordance with claim 7, further comprising:

a first spool, positionable in the heater to engage the first rotary drive, and wherein the first spool is configured to dispense the metal ribbon advanced from the heater to the second cooler through the first cooler; and a second spool, positionable in the second cooler to engage the second rotary drive, and wherein the second spool is configured to collect the metal ribbon, advanced from the heater to the second cooler through the first cooler.

9. The apparatus in accordance with claim 8, wherein the first rotary drive and the second rotary drive are simultaneously controllably operable to maintain a constant tension in the metal ribbon extending between the first spool and the second spool as the metal ribbon is advanced from the heater to the second cooler through the first cooler.

10. The apparatus in accordance with claim 8, further comprising:

first means for sensing a first linear speed of the metal ribbon dispensed from the first spool in the heater;

second means for sensing a second linear speed of the metal ribbon collected on the second spool in the second cooler; and third means for simultaneously controllably operating the first rotary drive at a first variable angular speed and the second rotary drive at a second variable angular speed to maintain the first linear speed of the metal ribbon substantially equal to the second linear speed of the metal ribbon as the metal ribbon is advanced from the heater to the second cooler through the first cooler.

11. A method of processing a metal ribbon using a heater, a first cooler, and a second cooler, the metal ribbon comprising a main portion and a sacrificial portion adjoining the main portion, the method comprising:

routing the sacrificial portion of the metal ribbon through the first cooler to the second cooler;

heating the main portion of the metal ribbon to a first temperature in the heater;

cooling the main portion of the metal ribbon in the first cooler at a first rate from the first temperature to a third temperature lower than the first temperature while successively advancing the main portion of the metal ribbon from the heater to the second cooler through the first cooler;

cooling the main portion of the metal ribbon in the second cooler at a second rate from the third temperature to a fourth temperature lower than the third temperature, wherein the first rate is higher than the second rate; and collecting the main portion of the metal ribbon within the second cooler.

12. The method in accordance with claim 11 further comprising marking a boundary on the metal ribbon between the main portion and the sacrificial portion.

13. The method in accordance with claim 11, wherein cooling the main portion of the metal ribbon from the first temperature to the third temperature comprises cooling the main portion of the metal ribbon using a cooling fluid, wherein the cooling fluid has a boiling point.

14. The method in accordance with claim 13, further comprising discharging the cooling fluid onto the main portion of the metal ribbon, while successively advancing the main portion of the metal ribbon from the heater to the second cooler through the first cooler, to cool the main portion from the first temperature to a second temperature lower than the first temperature and higher than the fourth temperature.

15. The method in accordance with claim 14, further comprising submerging the main portion of the metal ribbon into the cooling fluid, while successively advancing the main portion of the metal ribbon from the heater to the second cooler through the first cooler, to cool the main portion from the second temperature to the third temperature lower than the second temperature and higher than the fourth temperature.

16. The method in accordance with claim 11, further comprising dispensing the metal ribbon from a first spool, positionable in the heater, as the metal ribbon is advanced from the heater to the second cooler through the first cooler.

17. The method in accordance with claim 16, wherein collecting the main portion of the metal ribbon comprises collecting the metal ribbon on a second spool positionable in the second cooler as the metal ribbon is advanced from the heater to the second cooler through the first cooler.

18. The method in accordance with claim 17, further comprising maintaining a constant tension in the metal ribbon as the metal ribbon is advanced from the heater to the second cooler through the first cooler.

19. The method in accordance with claim 18, further comprising:

sensing a first linear speed of the metal ribbon dispensed from the first spool in the heater;

sensing a second linear speed of the metal ribbon collected on the second spool in the second cooler; and simultaneously controllably rotating the first spool at a first variable angular speed and the second spool at a second variable angular speed to maintain the first linear speed of the metal ribbon substantially equal to the second linear speed of the metal ribbon as the metal ribbon is advanced from the heater to the second cooler through the first cooler.

20. The apparatus in accordance with claim 1, wherein the second cooler is configured to collect the main portion and the sacrificial portion therein before the main portion and the sacrificial portion are transferred to another device.

* * * * *